United States Patent [19]

Summey

[11] 4,345,306

[45] Aug. 17, 1982

[54] LUMINAIRE MOUNTING DEVICE

[75] Inventor: Samuel T. Summey, East Flat Rock, N.C.

[73] Assignee: General Electric Company, Schenectady, N.Y.

[21] Appl. No.: 158,169

[22] Filed: Jun. 10, 1980

[51] Int. Cl.[3] ..... F21V 29/00

[52] U.S. Cl. ..... 362/294; 362/164; 362/264; 362/369; 362/370; 362/373; 362/432

[58] Field of Search ..... 362/164, 226, 264, 370, 362/373, 378, 432, 437, 294, 369; 431/346

[56] References Cited

U.S. PATENT DOCUMENTS

| | | | |
|---|---|---|---|
| 1,017,260 | 2/1912 | Goehst | 362/437 |
| 1,045,445 | 11/1912 | Schepmoes | 362/437 |
| 1,940,429 | 12/1933 | McKay | 362/437 |
| 3,364,346 | 1/1968 | Gunn | 362/264 |
| 3,535,066 | 10/1970 | Wagner | 431/346 |
| 3,675,007 | 7/1972 | Appleton et al. | 362/373 |
| 4,158,880 | 6/1979 | McJunkin, Jr. | 362/164 |

FOREIGN PATENT DOCUMENTS

| | | | |
|---|---|---|---|
| 341455 | 10/1920 | Fed. Rep. of Germany | 362/378 |

*Primary Examiner*—Peter A. Nelson

*Attorney, Agent, or Firm*—Ernest W. Legree; Philip L. Schlamp; Fred Jacob

[57] ABSTRACT

Wall mounted luminaire of hazardous duty type has mounting arm designed to protect luminaire parts from excessive pressure of explosive gases. The mounting arm is formed with an elongated wire passage of relatively small diameter wherein the gases are cooled and reduced in pressure before entering the luminaire housing.

10 Claims, 2 Drawing Figures

LUMINAIRE MOUNTING DEVICE

Figure 1:
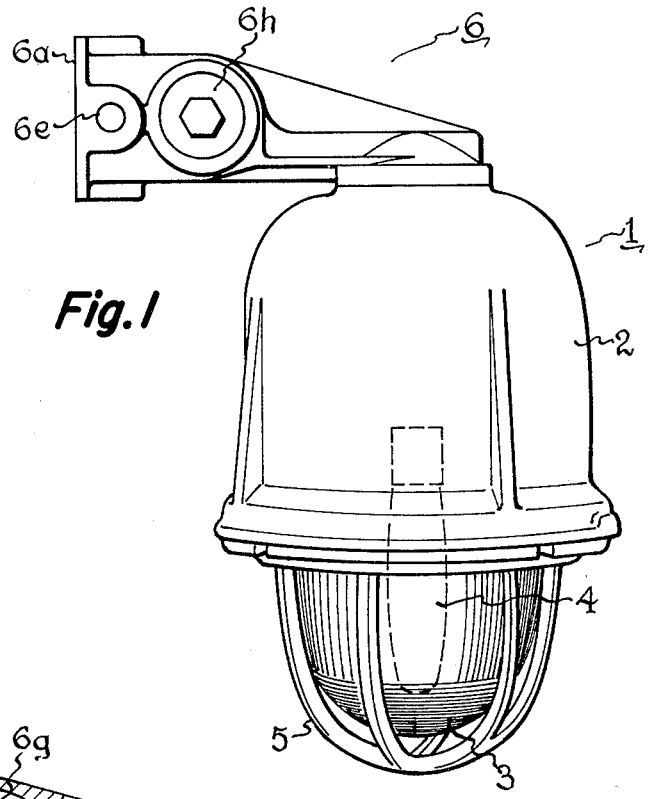

The present invention relates to luminaires, and more particularly concerns wall mounted luminaires of hazardous duty type, such as those installed in areas in which explosive gases or other volatile materials may be present or evolved.

In known luminaires of the above type, a wall mounting arm for securing the luminaire to a supporting wall is typically constructed so as to have a generally tubular form with wire access openings near the wall mounting end and a wireway passage communicating at one end with the wire access openings and extending to a luminaire connecting device at its other end, including an electrical "quick disconnect" mechanism. In the event of an explosion of gases in the vicinity of the luminaire, the pressure exerted by the gases passing through the tubular mounting arm and striking the quick disconnect device was often excessive, to such an extent as to damage the latter device. As a result, there was a risk not only of disabling the electrical connection to the luminaire and of damage to other parts of the luminaire but also of causing a further explosion in the interior of the luminaire which might result in injury to persons and property in the vicinity of the fixture.

It is an object of the invention to provide an improved mounting arm for luminaires of the above type whereby the luminaire and associated parts thereof are protected from explosive gases or the like evolved in the vicinity of the luminaire.

It is a particular object of the invention to protect the electrical "quick disconnect" device by which the luminaire is electrically connected to wires contained in the luminaire mounting arm.

It is another object of the invention to provide a luminaire mounting arm constructed such that the pressure of explosive gases entering the same is reduced before the gases reach the luminaire connecting device and the luminaire itself.

Other objects and advantages will become apparent from the following description and the appended claims.

With the above objects in view, the present invention in one of its aspects relates to a lighting fixture of hazardous duty type for installation in atmospheres in which explosive gases may be evolved comprising, in combination, an elongated bracket having a mounting portion at one end and a luminaire-attaching portion at its opposite end, the bracket having a hollow interior for passage of electrical conductors therethrough from one end to the other end, the hollow interior formed of enlarged chambers at the ends and an elongated narrow wireway opening at opposite ends into the enlarged chambers, a luminaire removably attached to the opposite end of the bracket, and means for automatically electrically connecting the luminaire to the electrical conductors upon attachment of the luminaire to the bracket, whereby any explosive gases entering the bracket at the one end are cooled and reduced in pressure before reaching the opposite end of the bracket by passage through the narrow wireway.

Figure 2:
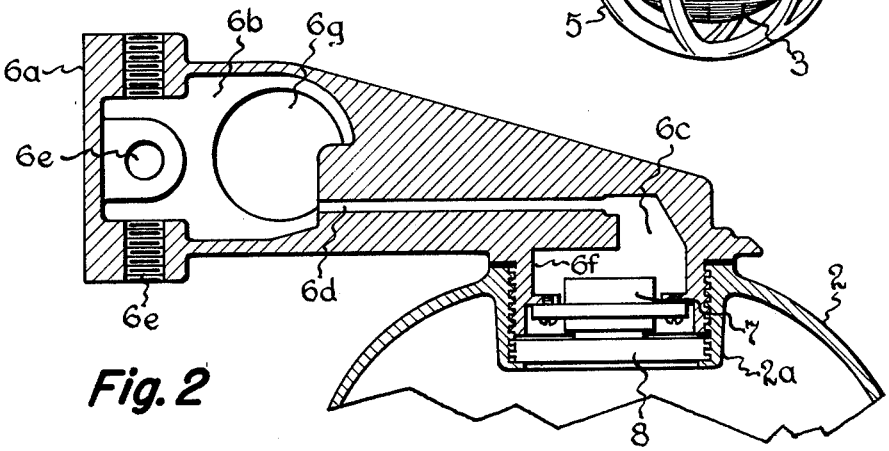

The invention will be better understood from the following description taken in conjunction with the accompanying drawing, in which:

FIG. 1 is a view in elevation of a hazardous duty type of lighting fixture in which the invention is embodied; and FIG. 2 is an enlarged cross-sectional view of the luminaire mounting bracket shown in FIG. 1 with associated parts of the attached luminaire.

Referring now to the drawing, and particularly to FIG. 1, there is shown a wall-mounted lighting fixture of hazardous duty type comprising a luminaire 1 having an upper ballast housing 2 and a transparent globe 3, such as glass, enclosing lamp 4 which is typically of gaseous discharge type such as a high pressure mercury vapor or sodium vapor type. The lamp is connected to electrical ballast components (not shown) contained in ballast housing 2 for operation thereby. Cage-like protective guard 5 secured at the bottom of ballast housing 2 extends around glass globe 3. Luminaire 1 is removably secured at the top of ballast housing 2 to the outer end of elongated wall mounting bracket 6 which is constructed in accordance with the invention.

Mounting arm or bracket 6, which is typically made of metal such as aluminum, is formed with a mounting portion **6*a* at one end for attachment to a wall or other vertical support surface and at its opposite end has means for removable attachment of luminaire 1 which depends therefrom. As seen best in FIG. 2, bracket 6 has a hollow interior comprising an enlarged chamber 6*b* at the wall mounting (rear) end, another chamber 6*c* at the luminaire mounting (front) end and a narrow wireway 6*d* interconnecting the two chambers. In a typical installation, two or more wire leads (not shown) enter bracket 6 by means of a wire conduit (not shown) which may be threadably secured in one of the openings 6*e* in the wall mounting portion, the wires extending into chamber 6*b*, then pass through wireway 6*d* into front chamber 6*c* and are connected to terminals (not shown) on plastic disk 7, which serves as one component of a quick disconnect device incorporated in the adjoining parts of the luminaire bracket assembly. Terminal disk 7 is secured as shown by screws or the like within hub portion 6*f* which projects downwardly from the front end of bracket 6 and is formed with threads on its outer surface. The top of ballast housing 2 is formed with an internally threaded socket portion 2*a* by which the luminaire may be screwed onto the depending bracket hub 6*f* for retaining the parts in operative assembly. Positioned at the bottom of socket portion 2*a* is another plastic terminal-holding disk 8 which coacts with disk 7 to make an electrical connection between conductive leads in bracket 6 and conductive leads within ballast housing 2** (not shown) when the parts are assembled.

The arrangement is such that when luminaire 1 is secured to the front end of support bracket 6 by turning housing socket **2*a* in threaded engagement with bracket hub 6*f***, electrical connection between the two components is automatically made as the parts are brought into operative assembly.

When the luminaire is removed from bracket 6 by unscrewing the parts, electrical disconnection is automatically effected. The described terminal disk arrangement is thus referred to herein as a "quick disconnect" device.

Access to wiring chamber **6*b* of the bracket for interconnecting wires or other service work is provided by openings 6*g* on opposite sides of the bracket, each opening being closed by a threaded cap 6*h*** (see FIG. 1).

In accordance with the principles of the invention, wireway **6*d*** is made long and narrow, with its length being many times its diameter, the latter usually being only sufficiently large to accommodate the wire leads passing therethrough, with enough clearance left for passage of gases therein.

In a typical example which has provided satisfactory results, wireway 6d had a length of 6 inches and a diameter of ¼ inch. In general, the length of the wireway should be at least 15 times its diameter, and the cross-sectional area of the bracket walls around the wireway should be at least 1 square inch to provide the desired cooling effect.

The plastic terminal disks of the quick disconnect device, especially disk 8, serve not only as terminal-holding members but also as barriers to contain an explosion that may occur in the interior of the bracket. While there is enough clearance in the threaded connection to permit venting of the gases in the explosion, the dimensions of the wireway in prior types of brackets were such that the exploding gases exerted high pressures on the plastic disks of the disconnect device so as to fracture or seriously weaken the disks, often causing disruption of the electrical connection to the luminaire, and resulting in many cases in a further explosion within the luminaire itself, with consequent risk of damage to persons and property.

By virtue of the present invention, passage of the explosive gases through the narrow wireway results in relatively rapid cooling of the gases, thus markedly reducing the pressure of the gases on the plastic barrier disks. While this arrangement causes increased pressure on the walls of the bracket near its mounting end, this portion has sufficient strength to easily withstand the increased stress thus produced.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim is:

1. A lighting fixture of hazardous duty type for installation in atmospheres in which explosive gases may be evolved comprising, in combination, an elongated bracket having a mounting portion and means for securing a conduit thereto at one end and a luminaire-attaching portion at its opposite end, said bracket having a hollow interior for passage of electrical conductors therethrough from said one end to said opposite end, said hollow interior formed of enlarged chambers at said ends and an elongated narrow wireway opening at opposite ends into said enlarged chambers, a luminaire removably attached to said opposite end of said bracket, and means for electrically connecting said luminaire to the electrical conductors upon attachment of said luminaire to said bracket, whereby any explosive gases entering said bracket at said one end from a conduit secured thereto are cooled and reduced in pressure before reaching said opposite end of said bracket by passage through said narrow wireway.

2. A fixture as defined in claim 1, said electric connecting means comprising a pair of co-acting terminal holding members arranged at the junction of said bracket and said luminaire, one of said members mounted in said luminaire-attaching portion of said bracket, the other of said members arranged in said luminaire.

3. A fixture as defined in claim 2, said luminaire-attaching portion of said bracket comprising a hollow threaded hub portion, said luminaire formed with a threaded socket portion engageable with said hub portion, said other terminal holding member arranged within said extending across said socket portion.

4. A fixture as defined in claim 1, said wireway having a length at least 15 times its diameter.

5. A fixture as defined in claim 4, said bracket formed of metal and defining said narrow wireway with walls having a cross-sectional area of at least 1 square inch.

6. A fixture as defined in claim 3, said co-acting terminal holding members being substantially disk-shaped plastic members.

7. A fixture as defined in claim 1, said luminaire comprising an upper ballast housing and a lower globe member forming a lamp enclosure, said luminaire ballast housing threadably engaging said luminaire-attaching portion of said bracket.

8. A bracket for supporting a luminaire of hazardous duty type, comprising an elongated arm member having a mounting portion and means for securing a conduit thereto at one end and a luminaire-attaching portion at its opposite end, said arm member having a hollow interior for passage of electrical conductors therethrough from said one end to said opposite end, said hollow interior formed of enlarged chambers at said ends and an elongated narrow wireway opening at opposite ends into said enlarged chambers, whereby any explosive gases entering said arm member at said one end from a conduit secured thereto are cooled and reduced in pressure before reaching said opposite end of said bracket by passage through said narrow wireway.

9. A bracket as defined in claim 8, said wireway having a length at least 15 times its diameter.

10. A bracket as defined in claim 9, said arm member being formed of metal and defining said narrow wireway with walls having a cross-sectional area of at least 1 square inch.

* * * * *